US006637336B2

(12) United States Patent
Suda et al.

(10) Patent No.: US 6,637,336 B2
(45) Date of Patent: Oct. 28, 2003

(54) METHOD FOR PRODUCING PRINTING PLATE, REUSING METHOD FOR PRINTING PLATE, AND PRINTING MACHINE

(75) Inventors: Yasuharu Suda, Mihara (JP); Hitoshi Isono, Mihara (JP); Hiroaki Ikeda, Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 42 days.

(21) Appl. No.: 09/975,509

(22) Filed: Oct. 12, 2001

(65) Prior Publication Data

US 2002/0062755 A1 May 30, 2002

(30) Foreign Application Priority Data

Nov. 29, 2000 (JP) ..... 2000-362864

(51) Int. Cl.[7] ..... B41C 1/10

(52) U.S. Cl. ..... 101/465; 101/466; 101/467; 101/478; 430/302

(58) Field of Search ..... 101/456, 457, 101/462, 463.1, 465, 466, 467, 478; 430/302

(56) References Cited

U.S. PATENT DOCUMENTS

| | | | | |
|---|---|---|---|---|
| 4,063,949 A | * | 12/1977 | Uhlig et al. | 101/467 |
| 5,674,658 A | * | 10/1997 | Burberry et al. | 430/302 |
| 6,058,841 A | * | 5/2000 | Ray et al. | 101/467 |
| 6,245,477 B1 | * | 6/2001 | Ray et al. | 101/457 |

FOREIGN PATENT DOCUMENTS

| | | | |
|---|---|---|---|
| EP | 1084863 | * | 3/2001 |
| JP | 63-102936 | | 5/1988 |
| JP | 10-250027 | | 9/1998 |
| JP | 11-105234 | | 4/1999 |
| JP | 11-147360 | | 6/1999 |
| JP | 11-254633 | | 9/1999 |
| WO | 00/46037 | * | 8/2000 |

OTHER PUBLICATIONS

T. Minabe, et al., The 5$^{th}$ Symposium on Recent Developments in Photocatalytic Reactions, Dec. 2, 1998.

D Heureuse et al., Abstract Patent No. EP0963839, Dec. 15, 1999 pp. 1–9.

* cited by examiner

*Primary Examiner*—Stephen R. Funk

(74) *Attorney, Agent, or Firm*—Armstrong, Westerman & Hattori, LLP.

(57) ABSTRACT

A method for making a reusable printing plate in which a hydrophobic image area is formed on a hydrophilic plate surface containing a photocatalyst. The method includes the steps of carrying out a hydrophobic agent application process in which a solution containing an organic compound having a property of reacting with the plate surface by a heating process and a property of being decomposed by the action of the photocatalyst when irradiated by light having a higher energy than a band gap energy of the photocatalyst is applied on the plate surface; carrying out an image area formation process in which a part of the plate surface is subjected to a heating process to form a hydrophobic image area; and carrying out a non-image area formation process in which the organic compound applied to an area other than the hydrophobic image area on the plate surface is removed.

15 Claims, 4 Drawing Sheets

METHOD FOR PRODUCING PRINTING PLATE, REUSING METHOD FOR PRINTING PLATE, AND PRINTING MACHINE

BACKGROUND OF THE INVENTION

1. Field of the Invention

The present invention relates to a method for making a reusable printing plate, a reusing method for the printing plate, and a printing machine. More specifically, the present invention relates to methods for making and reusing a printing plate, and a printing machine capable of writing an image directly on the printing plate based on digital data.

2. Description of Related Art

Recently, in general printing methods, many printing steps have become digitized. That is, image data are digitized by producing an image or text using, for instance, a personal computer, or by scanning an image using a scanner, and a printing plate is formed based directly on the digitized data. In this manner, printing workflow may be improved and the entire printing process may be abbreviated, and achievement of high image quality has been facilitated.

A so-called PS plate (i.e., a presensitized plate) has been generally utilized as a plate in a conventional printing process. The PS plate usually includes a hydrophilic non-image area, which is made of anodized aluminum oxide, and a hydrophobic image area which is formed on the surface of the hydrophilic non-image area by curing a photosensitive resin. However, a plurality of steps is required for making a printing plate using the PS plate, and hence, it is expensive and time-consuming to make such a plate. Accordingly, it is not easy to shorten the time required for the overall printing process and to lower the cost thereof. This is one of the main factors increasing the cost of printed matter, particularly for short run printing. Also, a developing step in which a developer is used, is required for cases where the PS plate is employed, and hence, it is not only a time-consuming process, but also creates a problem, from the viewpoint of preventing environmental pollution, in that developer waste must be treated.

Also, a method, in which a film containing punched out information of an original image is made to contact with a printing plate and is subjected to light exposure, is conventionally used for making the PS plate, and this production of the printing plate is one of the obstacles which prevents the formation of a plate directly from digital data and the digitization of the printing process. Moreover, in a conventional method, a printing plate must be replaced with a new one after the print job, and the used plate is discarded.

There are some commercial methods which, in consideration of the above-mentioned disadvantage of using the PS plate, correspond to the digitized printing process and in which the developing process may be omitted. For instance, Japanese Unexamined Patent Application, First Publication No. Sho 63-102936 discloses a preparation method in which ink containing a photosensitive resin is used for a liquid ink jet printer to be injected onto a printing plate material, and an image area formed by the ink is cured by a photo irradiation process. Also, Japanese Unexamined Patent Application, First Publication No. Hei 11-254633 discloses a method in which a color offset printing plate is made using an ink jet head which discharges a solid ink.

Moreover, a method is known in which a printing plate is made by sequentially applying a laser absorbing layer made of carbon black and a silicone resin layer onto a PET (polyethylene terephthalate) film, and heating the laser absorbing layer by drawing an image using a laser beam so that the silicone resin is subjected to laser ablation. Another method is also known in which a printing plate is made by sequentially applying a lipophilic laser absorbing layer and a hydrophilic layer onto an aluminum plate and subjecting the hydrophilic layer to laser ablation in the same manner as above using the laser beam.

Further, a method has been proposed in which a hydrophilic polymer is used as a recording medium, and a plate is made by converting an irradiated part so as to be lipophilic by optical imaging.

However, by applying the above-mentioned methods, although it may be possible to make a plate directly from digital data, the plate must be replaced with a new one after the print job in order to start the next printing process, and hence, the used plate is also wasted in these methods.

In addition, Japanese Unexamined Patent Application, First Publication No. Hei 10-250027, for instance, discloses a block copy of a latent image using a titanium oxide photocatalyst, a method for forming a block copy of the latent image, and a printing machine including a block copy of the latent image. Also, Japanese Unexamined Patent Application, First Publication No. Hei 11-147360 discloses a method for offset printing using a printing plate containing a photocatalyst. Both of these publications propose methods for reusing a printing plate in which light that activates the photocatalyst, i.e., substantially ultraviolet rays, is used for image writing, and the photocatalyst is converted so as to be hydrophobic via a heat treatment process.

Also, Japanese Unexamined Patent Application, First Publication No. Hei 11-105234 discloses a method for forming a lithographic printing plate in which, after a photocatalyst is activated, i.e., the photocatalyst is converted so as to be hydrophilic by using ultraviolet light, an image area is formed by heat mode drawing.

However, according to Professors Fujishima and Hashimoto of Tokyo University, it is confirmed that titanium dioxide photocatalyst is converted so as to be hydrophilic by a heat treatment process (refer to "Sanka chitan hyoumen no kouzo henka ni tomonau hikarireiki shinsuika gensho no kyodo ni kansuru kenkyu" which may be translated as "Research on the behavior of the photoinduced hydrophilicity phenomenon accompanying structural changes on a titanium dioxide surface", by Minabe et al, published in "Hikari shokubai hanno no saikin no tenkai" which may be translated as "Recent developments in photocatalytic reactions", pp. 124–125, (1998) in the Fifth Symposium for Photofunctional Materials Research Association), and hence, it is not possible to make or reuse a printing plate by using the methods disclosed in each of the above publications.

SUMMARY OF THE INVENTION

Accordingly, an object of the invention is to provide a method for making a reusable printing plate which may be directly imaged based on digital data and has a high image quality without chemical processing. Another object of the invention is to provide a method for reusing such a printing plate so that the plate may be used repeatedly. Yet another object of the invention is to provide a printing machine capable of using such a printing plate.

The present invention provides a method for making a reusable printing plate in which a hydrophobic image area is formed on at least a part of a hydrophilic surface containing a photocatalyst of the printing plate, comprising the steps of:

carrying out a hydrophobic agent application process in which a solution containing an organic compound having a property of reacting with or being fixed to the surface of the printing plate by a heating process and a property of being decomposed by the action of the photocatalyst when irradiated by light having a higher energy than the band gap energy of the photocatalyst is applied as a hydrophobic agent on the surface of the printing plate; carrying out an image area formation process in which at least a part of the surface of the printing plate is subjected to a heating process to form the hydrophobic image area; and carrying out a non-image area formation process in which the organic compound applied to an area other than the hydrophobic image area on the surface of the printing plate is removed.

According to the above method, it is possible to convert the plate surface so as to be hydrophilic by irradiating the plate surface with light having a higher energy than the band gap energy of the photocatalyst. This is due to the action wherein the photocatalyst itself is converted so as to be hydrophilic. The surface converted so as to be hydrophilic functions as a non-image area to which a hydrophobic ink does not attach. A hydrophobic image is formed on the hydrophilic plate surface by applying a solution, which contains an organic compound having a property of reacting with or being fixed to the plate surface via a heating process and a property of being decomposed and removed by the action of the photocatalyst under the irradiation of light having a higher energy than the band gap energy of the photocatalyst, onto the hydrophilic plate surface as a hydrophobic agent, and drying it, if necessary, at a temperature of about room temperature. Although the organic compound contained in the solution is weakly adhered to the hydrophilic plate surface after being applied or dried, once the temperature of the plate is increased to 50° C. or more, preferably 100° C. or more, the organic compound reacts with or is fixed to the hydrophilic plate surface to form a strong image area.

In accordance with another aspect of the invention, the organic compound is heated by irradiating light having a lower energy than the band gap energy of the photocatalyst so as to react with or be fixed to the surface of the printing plate to form the hydrophobic image area in the image area formation process.

The phrase "light having a lower energy than the band gap energy of the photocatalyst" means visible rays, infrared rays, etc.; however, from the viewpoint of heating efficiency, the use of infrared rays is preferable.

In yet another aspect of the invention, the surface of the printing plate is washed using a washing liquid in the non-image area formation process.

In yet another aspect of the invention, the organic compound is eliminated by ink tack or cleaning with fountain solution and removed at an initial stage of a printing process in the non-image area formation process.

According to the above method, since the organic compound present on a portion other than the hydrophobic image area, i.e., a non-heating portion, is removed by being washed away or eliminated by ink tack, cleaning with fountain solution, etc., so that the hydrophilic surface of the printing plate is exposed, the plate may function as a printing plate.

Also, by irradiating light having a higher energy than the band gap energy of the photocatalyst onto the plate surface after removing the ink thereon, it becomes possible to decompose the above-mentioned organic compound and return the plate to a state prior to the image formation.

In yet another aspect of the invention, the photocatalyst is a titanium dioxide photocatalyst.

In yet another aspect of the invention, the organic compound is one of an organotitanium compound, an organosilicone compound, a fatty acid dextrin, a thermoplastic resin, and a mixture thereof.

In yet another aspect of the invention, the solution containing the organic compound is an aqueous solution.

The criterion for the "aqueous solution" is that the content of the organic compound in the solution when applied is 30 wt. % or smaller.

In yet another aspect of the invention, the solution containing the organic compound is an organic solution.

The criterion for the "organic solution" is that the content of the organic compound in the solution when applied is greater than 30 wt. %.

The present invention also provides a reusing method for a printing plate which is made by using one of the above-mentioned methods, including the steps of: removing ink from the surface of the printing plate after the completion of a printing process; and regenerating the printing plate by converting the surface of the printing plate so as to be hydrophilic by decomposing and removing the hydrophobic image area by the irradiation of light having a higher energy than the band gap energy of the photocatalyst onto the surface of the printing plate.

According to the above reusing method, since the surface of the printing plate is readily regenerated when light having a higher energy than the band gap energy of the photocatalyst is radiated, it is effective for reducing the time and cost required for the regeneration process of the printing plate.

The present invention also provides a reusing method for a printing plate made by using one of the above mentioned methods, including the steps of: removing ink from the surface of the printing plate after the completion of a printing process; and regenerating the printing plate by converting the surface of the printing plate so as to be hydrophilic by alternately carrying out an operation of decomposing and removing the hydrophobic image area by the irradiation of light having a higher energy than the band gap energy of the photocatalyst onto the surface of the printing plate, and an operation of washing the surface of the printing plate by using a washing agent.

According to the above reusing method, since the surface of the printing plate may be more readily regenerated due to synergistic effects of the decomposition action of the photocatalyst and the washing agent when the operation of irradiating light having a higher energy than the band gap energy of the photocatalyst onto the surface of the printing plate and the operation of washing the surface of the printing plate using a washing agent are carried out repeatedly, it is effective for further reducing the regeneration cost.

The present invention also provides a printing machine including: a print drum which is provided with a hydrophilic plate surface containing a photocatalyst; a plate cleaner which removes ink on the plate surface; a hydrophobic agent application device which applies a solution containing an organic compound having a property of reacting with or being fixed to the plate surface via a heating process and a property of being decomposed by the action of the photocatalyst when irradiated by light having a higher energy than the band gap energy of the photocatalyst, as a hydrophobic agent on the plate surface; an image area formation device which forms a hydrophobic image area by subjecting at least a part of the plate surface to a heating process; a dryer which dries the plate surface; and a regeneration device which erases the hydrophobic image area by irradiating light having a higher energy than the band gap energy of the photocatalyst onto the plate surface.

In another aspect of the invention, the above-mentioned printing machine further includes a hydrophobic agent removing unit which removes the organic compound applied on an area other than the hydrophobic image area on the plate surface.

In yet another aspect of the invention, the image area formation device forms an image area by heating the organic compound using irradiation of light having a higher energy than the band gap energy of the photocatalyst so that the organic compound is reacted with or fixed to the plate surface.

In yet another aspect of the invention, the photocatalyst is a titanium dioxide photocatalyst.

In yet another aspect of the invention, the organic compound is one of an organotitanium compound, an organosilicone compound, a fatty acid dextrin, a thermoplastic resin, and a mixture thereof.

According to the above printing machine, a method for making a reusable printing plate, and a reusing method for the printing plate according to the present invention may be suitably carried out using the printing machine.

BRIEF DESCRIPTION OF THE DRAWINGS

Some of the features and advantages of the invention have been described, and others will become apparent from the detailed description which follows and from the accompanying drawings, in which.

DETAILED DESCRIPTION OF THE INVENTION

The invention summarized above and defined by the enumerated claims may be better understood by referring to the following detailed description, which should be read with reference to the accompanying drawings. This detailed description of particular preferred embodiments, set out below to enable one to build and use particular implementations of the invention, is not intended to limit the enumerated claims, but to serve as particular examples thereof.

Figure 1:
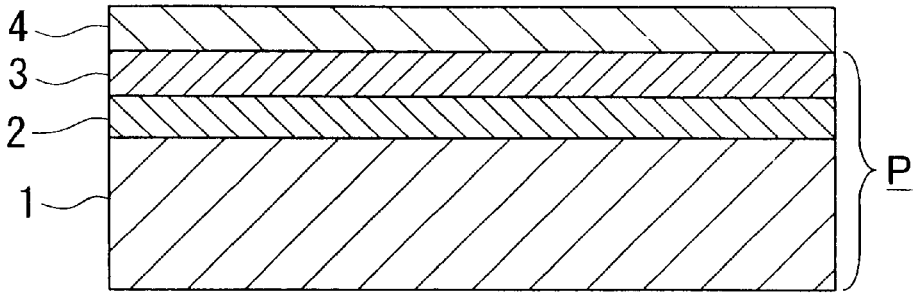
FIG. 1 is a cross-sectional view showing the structure of a printing plate, including an organic compound layer, used in a method for making a reusable printing plate and a reusing method for the printing plate according to an embodiment of the present invention.

FIG. 1 is diagram showing a cross-sectional view of the surface of a printing plate according to an embodiment of the present invention. In FIG. 1, a printing plate (or simply a plate) P includes a base material 1, an intermediate layer 2, and a coating layer 3. As shown in FIG. 1, an organic compound layer 4, which will be described later, is formed on the surface of the coating layer 3 (i.e., the surface of the printing plate).

The base material 1 may be made of a metal, such as aluminum or stainless steel, or a polymer film. However, the material used for the base material 1 is not particularly limited to a metal or a polymer film, and other materials may also be used.

The intermediate layer 2 is formed on the surface of the base material 1. Examples of a material which may be used to form the intermediate layer 2 include a silicone type compound such as silica ($SiO_2$), a silicone resin, and a silicone rubber. Among these, in particular, as a silicone resin, alkyd silicone, urethane silicone, epoxy silicone, acrylic silicone, polyester silicone, and the like may be used. The function of the intermediate layer 2 includes an improvement in the contact between the base material 1 and the coating layer 3 (which will be described later) to assure the adhesion of the coating layer 3 to the base material 1. By placing the intermediate layer 2 between the base material 1 and the coating layer 3, if necessary, it becomes possible to maintain the bonding strength of the coating layer 3 to the base material 1. Note that the intermediate layer 2 may be unnecessary for the case where a sufficient bonding strength of the coating layer 3 to the base material 1 is obtained. Also, when the base material 1 is made by using a polymer film, etc., the intermediate layer 2 may be formed in order to protect the base material 1.

The coating layer 3 which includes titanium oxide as a photocatalyst in this embodiment is formed on the intermediate layer 2. The surface of the coating layer 3 exhibits a highly hydrophilic property when irradiated by light having a higher energy than the band gap energy of the photocatalyst, such as ultraviolet rays. This phenomenon occurs due to the properties of the titanium oxide photocatalyst.

Figure 2:
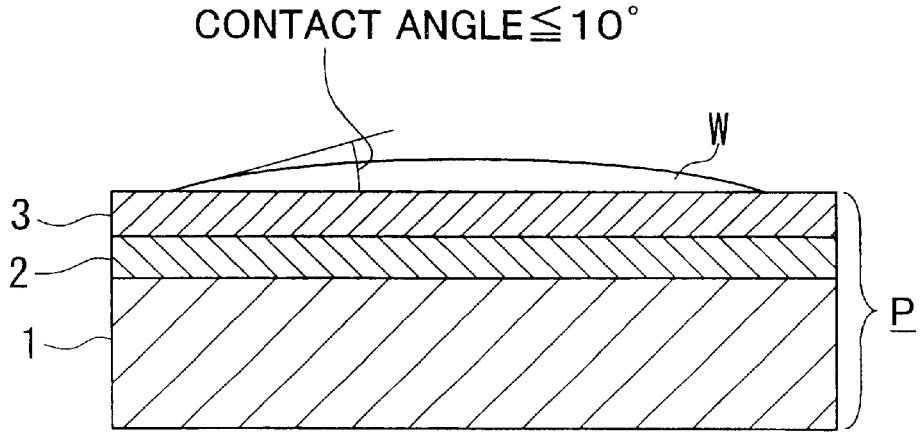
FIG. 2 is a cross-sectional view showing the structure of a printing plate used in a method for making a reusable printing plate and a reusing method for the printing plate according to an embodiment of the present invention as well as showing the hydrophilic property of a coating layer surface.

FIG. 2 shows a state in which the coating layer 3, which has been converted so as to be hydrophilic by the irradiation of ultraviolet rays, is exposed after the organic compound used for the non-image area has been removed. In this way of exposing the coating layer 3 having the hydrophilic property, it becomes possible to form a non-image area on the printing plate P.

In order to maintain the above-mentioned properties or hydrophilicity, or to improve the strength of the coating layer 3 or adhesion to the base material 1, various additives may be added to the coating layer 3. Examples of such additives include silica compounds, such as silica, silica sol, organosilane, and a silicone resin, metallic oxides made of such metals as zirconium and aluminum, and fluorinated resins.

As a titanium oxide photocatalyst, a rutile type, an anatase type, and a brookite type are known, and any of these titanium oxide photocatalysts may be used according to the embodiment of the present invention alone or in combination. Also, as will be described later, it is preferable that the particle size of the titanium oxide photocatalyst be small to a certain degree. More specifically, it is preferable that the particle size of the titanium oxide photocatalyst be about 0.1 μm or less in order to increase its photocatalytic function by which organic compounds are decomposed via a photo irradiation process in which light having a higher energy than the band gap energy of the photocatalyst is used. Note that although the use of a titanium oxide photocatalyst is appropriate according to the present invention, it is not limited as such, and other photocatalysts may also be suitably used according to an embodiment of the present invention.

Examples of commercially available titanium oxide photocatalysts which may be used in embodiments of the present invention include: ST-01, ST-21, ST-K01 (a processed product of the former), ST-K03, STS-01 (a dispersion type), STS-02, and STS-21 (all of which are products of Ishihara Sangyo Kaisha, Ltd.); SSP-25, SSP-20, SSP-M, CSB, CSB-M, LACTI-01 (a coating type), and LACTI-03-A (products of Sakai Chemical Industry Co., Ltd.); TKS-201, TKS-202, TKC-301, and TKC-302 (products of Tayca Corporation); and PTA, TO, and TPX (products of Tanaka Tensha Ltd.).

Also, it is preferable that the thickness of the coating layer 3 be within the range between about 0.01 and 10 μm. This is because if the thickness of the coating layer 3 is too small, it becomes difficult to obtain the above-mentioned characteristics of the coating layer 3, and if the thickness of the coating layer 3 is too large, the layer 3 tends to be easily cracked, thereby decreasing the printing resistance property. Since the generation of cracks is often observed when the thickness of the coating layer 3 exceeds 20 μm, it is necessary to recognize this thickness of 20 μm as the upper limit even for the cases where the above-mentioned range between about 0.01 and 10 μm should be modified. Moreover, in practice, it is preferable that the thickness of the coating layer 3 be within the range between about 0.1 and 3 μm.

As a method for forming the coating layer 3, a sol application method, an organic titanate method, a vapor deposition method, and the like may be suitably selected and employed. If the sol application method is used, various additives such as solvents, cross-linking agents, and surfactants may be added to an application liquid in addition to the titanium oxide photocatalyst and the above-mentioned various materials which improve the strength of the coating layer 3 and adhesion to the base material 1. Also, although the application liquid may be an ordinary-temperature dry-type or a heat-dry type, the use of the latter is preferable. The reason for this is that it is advantageous for increasing the strength of the coating layer 3 by heat in order to improve the printing resistance property of the resultant plate.

Also, it is possible to produce a photocatalyst coating layer having a higher strength by using a physical method in which, for instance, an amorphous titanium layer is grown on a metal base by using a vacuum evaporation method and is then crystallized by a heat treatment process.

The organic compound layer 4 may be formed by applying a solution, in which an organic compound that acts as a hydrophobic agent when reacted with or fixed on the surface of the coating layer 3 is dissolved in a liquid such as water or an organic solvent, onto the surface of the coating layer 3 and drying it.

Note that the term "an organic compound" means an organic compound which possesses both "a property of reacting with or being fixed on the surface of a coating layer (i.e., the printing plate surface) by a heat treatment process" and "a property of being decomposed by the action of a photocatalyst under the irradiation of light having a higher energy than the band gap energy of the photocatalyst". Hereinafter the term "an organic compound" used in this specification means an organic compound having the above-mentioned properties.

Also, "a solution containing an organic compound" may be adjusted to be an aqueous solution or an organic solution depending on the type of the organic compound as will be described later. Note that the criterion for the "aqueous solution" is that the content of the organic compound in the solution when applied is 30 wt. % or smaller, and that for the "organic solution" is that the content of the organic compound in the solution when applied is greater than 30 wt. %. Any organic solvent may be used as long as it is capable of dissolving or dispersing the organic compound used, and a paraffin type or isoparaffin type organic solvent may be suitably employed from the viewpoint of cost and readiness in handling. However, the types of the organic solvents are not limited as such, and other organic solvents may also be used according to an embodiment of the present invention.

Next, a method for making the printing plate P and for reusing the printing plate according to an embodiment of the present invention will be explained. The method for making the printing plate P includes a "hydrophobic agent application process", an "image area formation process", and a "non-image area formation process". The method of reusing the printing plate P includes an "ink removing process" and a "regeneration process".

First, the method for making the printing plate P will be explained. FIGS. 3A through 3F are diagrams showing the concept of making and regenerating the printing plate P.

Note that the term "plate-making" used hereinafter in this specification means the formation of a hydrophobic image area, after a solution containing an organic compound is applied onto the printing plate surface, on the printing plate surface by heat treating at least a part of the plate surface based on digital data, and removing the organic compound on the plate surface which is not subjected to the heat treatment.

First of all, light of a wavelength having a higher energy than the band gap energy of a titanium dioxide photocatalyst is irradiated onto the surface of the coating layer 3 so that the entire surface of the printing plate P may be converted so as to be hydrophilic having a contact angle with water of 10° or less as shown in FIG. 2. The light of a wavelength having a higher energy than the band gap energy of a titanium dioxide photocatalyst is, more specifically, ultraviolet light having a wavelength of 380 nm or less.

Figure 3:
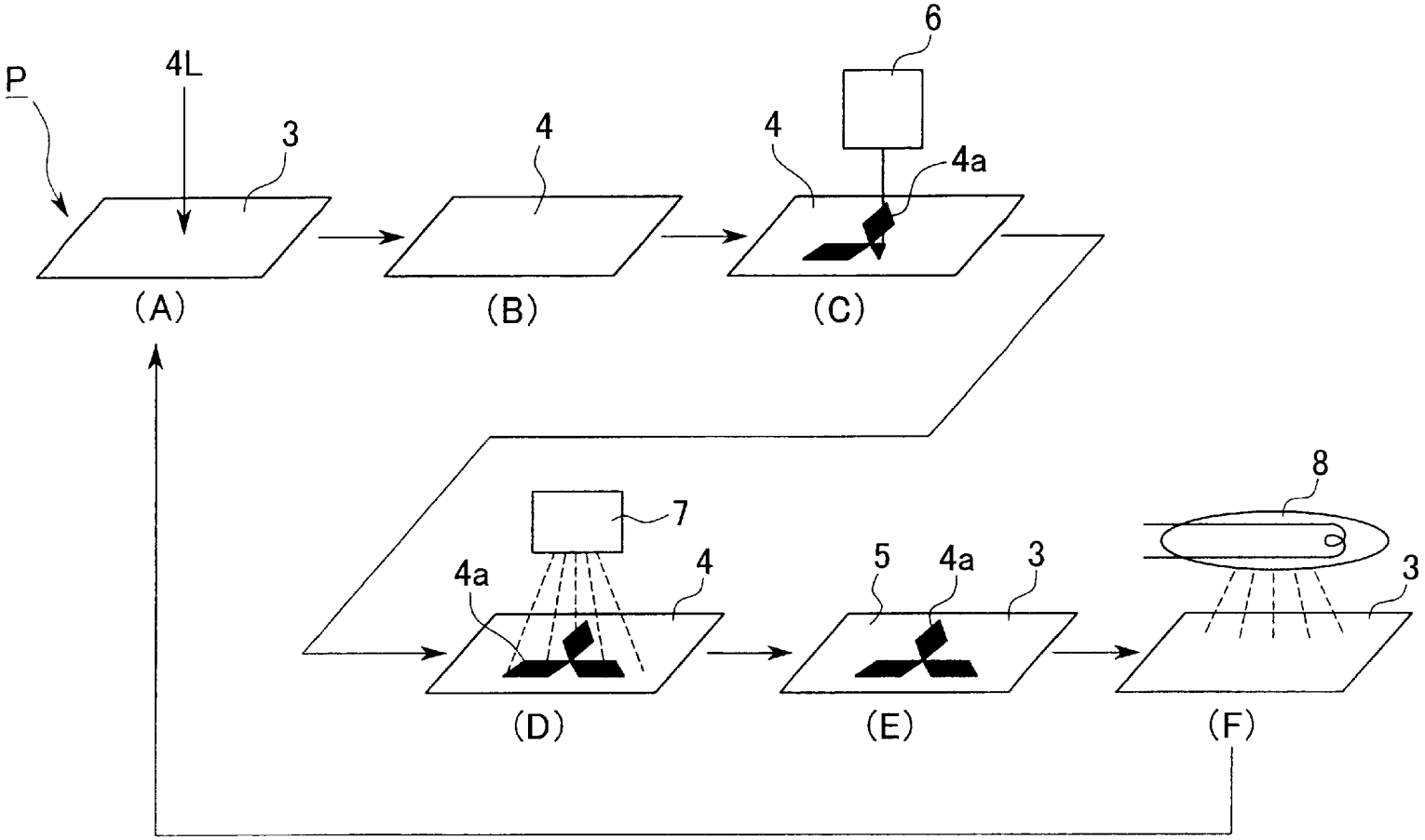
FIGS. 3A through 3F are conceptual diagrams showing a method for making a reusable printing plate and a reusing method for the printing plate according to an embodiment of the present invention.

Then, in the hydrophobic agent applying process, a solution containing an organic compound (indicated as 4L in FIG. 3A) is applied onto the surface of the hydrophilic coating layer 3 and dried, if necessary, at a temperature of about room temperature to prepare a printing plate P in which the organic compound layer 4 is formed on the coating layer 3 as shown in FIG. 1. FIG. 3A shows a state in which the above-mentioned solution 4L containing an organic compound is applied to the plate P, and FIG. 3B shows a state in which the applied solution 4L is dried at a temperature of about room temperature and the organic compound layer 4 is formed.

This state of the surface of the coating layer 3 is called an "initial state of plate-making" in this specification. The phrase the "initial state of plate-making" may be regarded as referring to the start of the actual printing process. More specifically, it may be regarded as the state in which digitized data of a given image have been already prepared and the data are about to be written onto the plate.

Next, in the image area formation process, an image area 4 is formed on the surface of the coating layer 3 in the above-mentioned state which is covered by the organic compound layer 4.

The formation of the image area 4 is carried out according to digital data relating to the image so as to correspond to the digital data. The image area is a hydrophobic portion whose contact angle with respect to water is about 50° or more, preferably 80° or more, and hence, the printing hydrophobic ink is easily adhered to the image area, whereas fountain solution is difficult to adhere to the image area.

As a method for forming the hydrophobic image area based on the image data, the use of a method, in which the organic compound layer 4 is heated so that the organic compound reacts with or is fixed on the surface of the coating layer 3 is suitable. A printing plate may be prepared by heating the image area and then removing the organic compound which is applied to portions other than the image area, i.e., the portions which were not heated (non-heated portion).

As a heating method, it is preferable to carry out a heating process by irradiating light having a lower energy than the band gap energy of a photocatalyst. The phrase "light having a lower energy than the band gap energy of a photocatalyst" means, more specifically, infrared rays. If light as such is irradiated, the organic compound may react with or be fixed on the surface of the coating layer 3 without being decomposed.

In this embodiment, as shown in FIG. 3C, at least a part of the organic compound layer 4 is heated by irradiating infrared rays using an infrared ray writing head 6 so that an image area 4*a* is formed by reacting or fixing the organic compound with/onto the surface of the coating layer 3.

After the image area 4*a* is formed, the organic compound on the non-heated portion is removed and washed out by spraying water or an aqueous cleaning agent onto the organic compound layer 4 using a washing spray 7 as shown in FIG. 3D so that a non-image area 5 is exposed. In this manner, the formation of the image area 4*a* and the non-image area 5 on the surface of the coating layer 3 is completed as shown in FIG. 3E, and the plate may be readily used for a printing process.

Note that although an embodiment in which the image area is formed by heating the image area using light energy is shown in FIGS. 3A through 3F, other methods in which, for instance, the organic compound layer 4 is directly heated by using a thermal head may also be employed.

After the completion of the above-mentioned processes, a mixture of printing hydrophobic ink and fountain solution is applied onto the surface of the coating layer 3. Then, a printing plate, for instance one shown in FIG. 4, is prepared.

Figure 4:
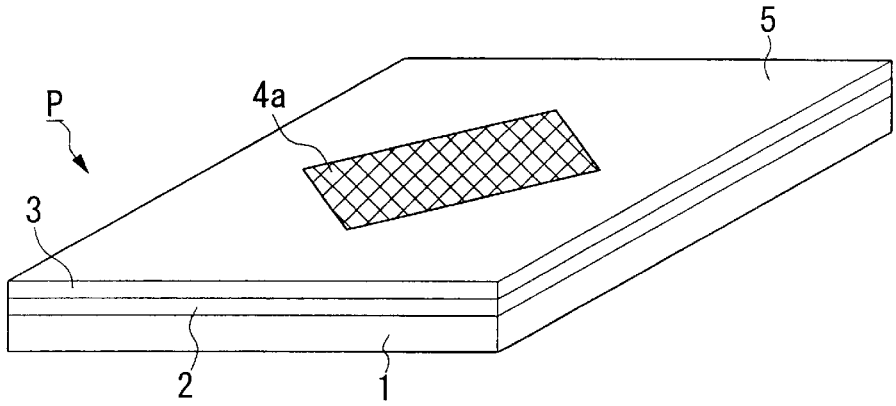
FIG. 4 is a diagram showing an example of an image (an image area) formed on a plate surface and a background (a non-imaging portion)

In FIG. 4, the shaded area indicates the hydrophobic image area 4*a*, i.e., a portion where an image is formed by the reaction or fixation of an organic compound with/onto the surface of the coating layer 3 containing a photocatalyst, onto which a hydrophobic ink is attached. The blank portion, i.e., the hydrophilic portion, indicates the non-image area 5 by which the hydrophobic ink is repelled and the fountain solution is preferentially attached. In this manner, a pattern is formed, and accordingly, the surface of the coating layer 3 functions as a printing plate. After this, a normal printing process may be carried out and completed.

Next, a method for reusing the printing plate P by regenerating the plate P according to an embodiment of the present invention will be explained.

Note that the phrase "regeneration of a plate" means the return of a plate to the state of "an initial state of plate-making" by first converting the surface of the plate, at least a part of which exhibits hydrophobic properties and the rest exhibits hydrophilic properties, so as to be hydrophilic entirely and uniformly, and then applying a solution containing an organic compound onto the hydrophilic plate surface and drying it, if necessary, at a temperature of about room temperature.

As the ink removing process, ink, fountain solution, paper dust, etc., attached to the surface of the coating layer 3 are wiped off from the surface after the completion of a printing process.

Then, as a regeneration process, light having a higher energy than the band gap energy of a photocatalyst is irradiated onto the entire surface of the coating layer 3, at least part of which exhibits a hydrophobic property. In this manner, the organic compound forming the image area 4 is decomposed and removed so that the entire surface of the coating layer 3 turns into a hydrophilic surface having a contact angle of about 10° with respect to water W. That is, it is possible to return the printing plate P to the state shown in FIG. 2.

The characteristics of the plate of which the organic compound present on the surface of the coating layer 3 is decomposed and removed to give high hydrophilicity to the plate by the irradiation of light having a higher energy than the band gap energy of the photocatalyst, e.g., ultraviolet light, are derived from the properties of the titanium oxide photocatalyst used. In this embodiment, a case is shown where the surface of the coating layer 3, i.e., the hydrophilic surface, is exposed by decomposing the organic compound which forms the image area 4*a* using only the irradiation of ultraviolet light emitted from an ultraviolet ray irradiation lamp 8 as shown in FIG. 3F.

It is possible to return the plate to the initial state of plate-making by applying the liquid 4L onto the surface of the coating layer 3, which is entirely converted so as to be hydrophilic by the irradiation of ultraviolet light, again at a room temperature, and drying it at a suitable temperature, e.g., about a room temperature, if necessary.

Also, by repeating the process in which the organic compound is decomposed by the irradiation of light having a higher energy than the band gap energy of the photocatalyst and the process in which the surface of the coating layer 3 is washed by using water or an aqueous cleaning solution, it becomes possible to readily convert the entire surface of the coating layer 3 so as to be hydrophilic having a contact angle of about 10° with respect to water.

As for the types of the above-mentioned organic compound, it is preferable to use one which not only reacts with or strongly bonds to the hydrophilic portion of the plate surface to give a hydrophobic property to the surface when heated (i.e., such reaction or bonding does not substantially occur at room temperature), but which can also be easily decomposed by the action of the titanium oxide photocatalyst under the irradiation of the ultraviolet light.

More specifically, according to an embodiment of the present invention, it is preferable to use thermoplastic resins, and it is more preferable to use thermoplastic resins having a functional group, such as a hydroxyl group, a carboxyl group, an ester group, and a carbonyl group, which reacts or strongly interacts with a hydrophilic functional group on the plate surface when the resin is melted by heat and formed into a film. In addition, since it is required that the organic compound not only to give hydrophobic property to the hydrophilic surface but also the above-mentioned reaction or the bonding is not taken place at room temperature, it is preferable that the thermoplastic resin is the one which is dispersed as fine particles in an aqueous or oily solvent rather than the one which is dissolved in a solution Although there are various types of resins which known as the above-mentioned thermoplastic resin, it is preferable to use, as a hydrophobic agent used in an embodiment of the present invention, one which can form the above-mentioned fine particles. Examples of such resins include an acrylic resin, such as (meth)acrylic acid and methacrylate, styrene resins, a styrene-acryl resin, such as styrene.acrylic acid and styrene.acrylate, urethane resins, phenol resins, an ethylenic resin, such as ethylene, ethylene.acrylic acid, ethylene acrylate, ethylene-vinyl acetate, and denatured ethylene-vinyl acetate, and a vinyl resin, such as vinyl acetate, vinyl propionate, polyvinyl alcohol, and polyvinyl ether. These resins may be used singularly or may be in a mixture, if necessary.

Also, according to an embodiment of the present invention, as the above-mentioned organic compounds, use of an organotitanium compound and an organosilicone compound, such as an organosilane compound, is preferable. Since these compounds are fixed on the plate surface by reacting with the hydroxyl groups of the titanium oxide photocatalyst when heated, a hydrophobic group monolayer is theoretically formed on the surface of the titanium oxide photocatalyst.

A reaction scheme I, where a tetraalkoxide type organic titanium is used as an example of the organotitanium compound, is shown below:

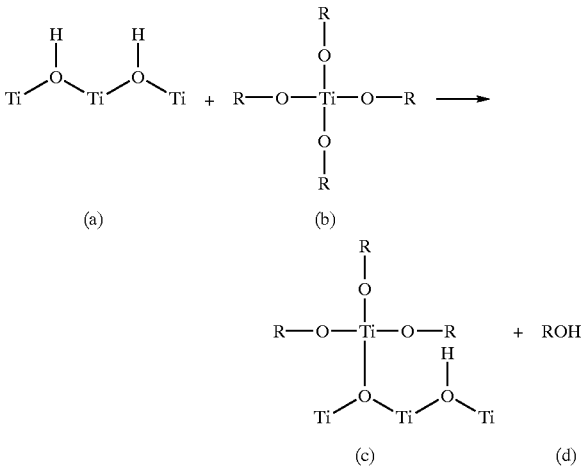

where (a) indicates the surface of titanium oxide (hydrophilic), (b) indicates an organotitanium compound, (c) indicates the surface of titanium oxide which has been converted so as to be hydrophobic by the formation of an organic hydrophobic group, and (d) indicates a by-product.

Also, a reaction scheme II, where a tetraalkoxide type organic silane is used as an example of the organosilane compound, is shown below:

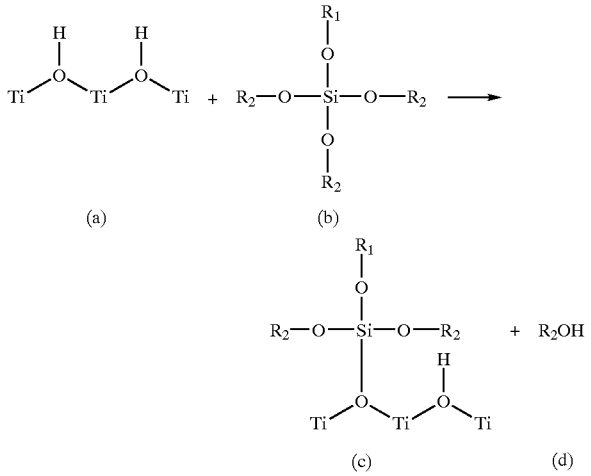

where (a) indicates the surface of titanium oxide (hydrophilic), (b) indicates an organosilane compound, (c) indicates the surface of titanium oxide which has been converted so as to be hydrophobic by the formation of an organic hydrophobic group, and (d) indicates a by-product.

As shown in the above reaction schemes I and II, the surface of a photocatalyst coating layer having a hydrophilic property due to the presence of hydroxyl groups is converted so as to be hydrophobic by the addition of hydrocarbon groups (R, $R_1$, and $R_2$). Note that the organotitanium compound in this embodiment is not limited to tetraalkoxide type organic titanium and the organosilane compound (i.e., organosilicone compound) is also not limited to tetraalkoxide type organic silane.

If these organotitanium compounds or organosilicone compounds are used, since the hydrophobic group monolayer may be quickly decomposed and removed by the action of the photocatalyst in combination with the irradiation of ultraviolet light when the plate is returned to its initial state of plate-making after the printing process, and the entire printing surface is converted so as to be hydrophilic again, it is effective for shortening the time required for the regeneration process of the plate and for decreasing the light energy. Also, since the hydrophobic group monolayer is chemically reacted with the surface of the photocatalyst, it has an advantage in that the printing resistance property of the plate becomes very high in comparison with cases where hydrophobic fats and oils are merely applied on the plate surface.

Examples of the organotitanium compounds and the organosilane compounds (i.e., organosilicone compounds) are shown below as categorized in groups 1–3, and 4–7, respectively.

1. alkoxy titanium such as tetraisopropoxy titanium, tetra-n-butoxy titanium, and tetrastearoxy titanium;
2. titanium acylate such as tri-n-butoxy titanium acylate, and isopropoxy titanium triacylate;
3. chelated titanium such as diisopropoxy titanium bisacetylacetonate, and dihydroxy.bislactatotitanium;
4. alkoxysilane such as trimethylmethoxysilane, trimethylethoxysilane, dimethyldiethoxysilane, methyltrimethoxysilane, tetramethoxysilane, methyltriethoxysilane, tetraethoxysilane, methyldimethoxysilane, octadecyltrimethoxysilane, and octadecyltriethoxysilane;
5. chlorosilane such as trimethylchlorosilane, dimethyldichlorosilane, methyltrichlorosilane, methyldichlorosilane, and dimethylchlorosilane;

6. silane coupling agents such as vinyl trichlorosilane, vinyl triethoxysilane, γ-chloropropyltrimethoxysilane, γ-chloropropylmethyldichlorosilane, γ-chloropropylmethyldimethoxysilane, γ-chloropropylmethyldiethoxysilane, and γ-aminopropyltriethoxysilane; and
7. fluoroalkylsilane such as perfluoroalkyltrimethoxysilane.

Note that the organic compounds which may be used according to the embodiment of the present invention are not limited to those shown above. Moreover, the organic compounds may be diluted with, for instance, a solvent, if necessary, and other additives such as thermoplastic resins, hydrophobic fats and oils, and fluorinated compounds may be added to the organic compounds.

Further, as the above-mentioned organic compound, it is preferable to use fatty acid dextrin. Since fatty acid dextrin strongly interacts with the hydroxyl groups of the titanium oxide photocatalyst and is fixed onto the surface thereof when heated, the image area formed by fatty acid dextrin may be stably used for a printing process without, for instance, being substituted by fountain solution.

An interactive reaction scheme III, where dextrin palmitate is used as an example of the fatty acid dextrin is shown below:

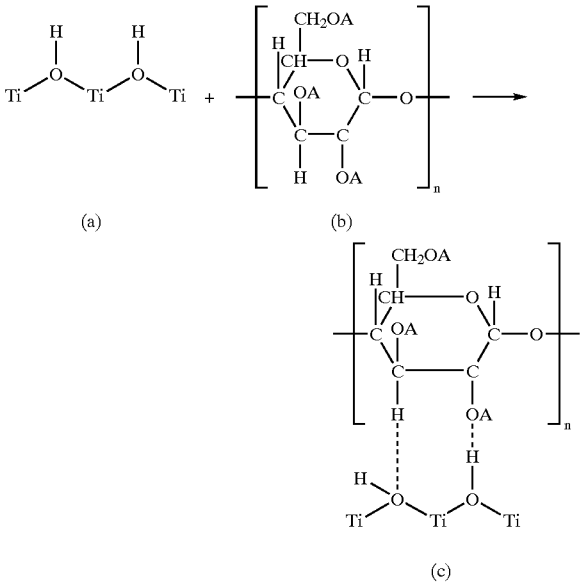

where (a) indicates the surface of titanium oxide (hydrophilic), (b) indicates a fatty acid dextrin, and (c) indicates the surface of titanium oxide converted so as to be hydrophobic by the formation of an organic hydrophobic group.

Note that although the use of dextrin (palmitate/2-ethylhexanoate) and dextrin myristate in addition to dextrin palmitate are suitable, fatty acid dextrin which may be used according to an embodiment of the present invention is not limited as such.

Figure 5:
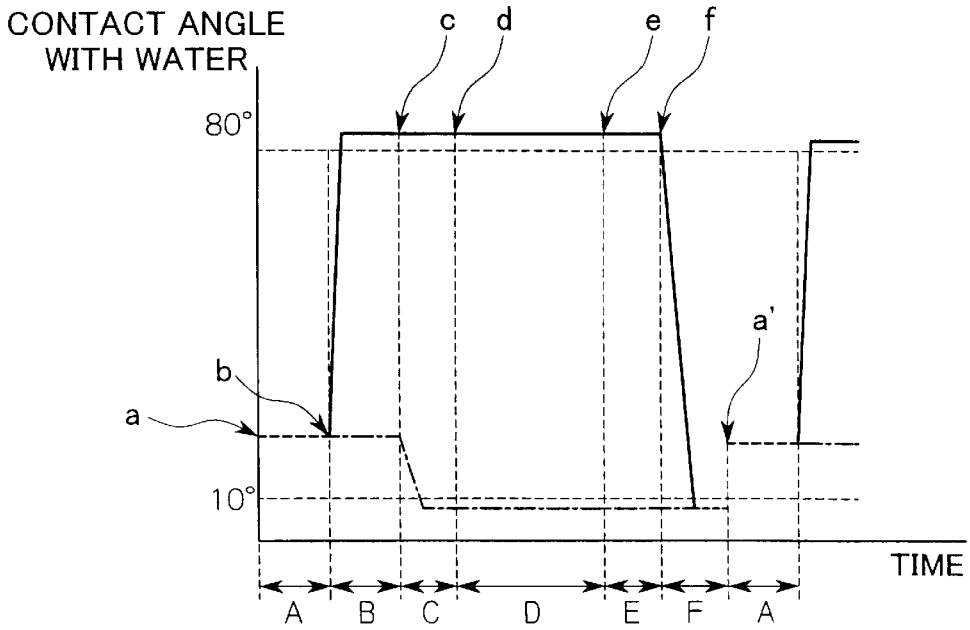
FIG. 5 is a graph for explaining the formation of an image area on a hydrophilic plate surface by using an organic compound and the removal of the image area after the completion of a printing process by the irradiation of ultraviolet light with respect to time.

FIG. 5 is a graph for explaining the above-mentioned properties of the printing plate P in relation to the contact angle with water. In the graph shown in FIG. 5, time (or operation) is plotted on the horizontal axis and the contact angle with respect to water is plotted on the vertical axis. Accordingly, in connection with the printing plate P according to the embodiment of the present invention, the change in the contact angle of the surface of the coating layer 3 with respect to water (i.e., hydrophobic ⇆ hydrophilic states) in relation to time or operation is shown in the graph. In FIG. 5, an alternating long and short dashed line indicates the surface of the coating layer 3 or the non-image area 4, and the solid line indicates the image area 4.

First, ultraviolet rays are irradiated onto the surface of the coating layer 3 so that the surface shows a high hydrophilicity of which the contact angle with water is about 10°, and preferably equal to or less than 10°.

Then, as the hydrophobic agent application process (i.e., process A shown in FIG. 5), the above-mentioned solution containing an organic compound is applied (indicated by the point "a" in FIG. 5) and, if necessary, the solution is dried at a temperature of about room temperature. Note that in FIG. 5, a case where no drying step is required is shown. The state of the printing plate after the completion of the application of the solution containing an organic compound may be regarded as the "initial state of plate-making".

Thereafter, as the image area formation process (process B), a portion of the organic compound corresponding to an image area on the surface of the coating layer 3 is heated to form the image area (point "b"). In this manner, the organic compound is reacted with or fixed onto the surface of the coating layer 3, and the resulting image area shows a high hydrophobicity. On the other hand, the organic compound is substantially not reacted with or fixed onto the non-image area and the same state as the one prior to the image area formation process is maintained.

After the completion of the image area formation process, as the non-image area formation process (process C), removable of the organic compound on the non-image area from the surface of the coating layer 3 is started by using a suitable washing method (point "c"). That is, the surface of the hydrophilic coating layer 3 is exposed as the non-image area 5. Accordingly, a hydrophobic image area formed by the reaction or the fixation of the organic compound and a hydrophilic non-image area formed by removing the organic compound appear on the surface of the coating layer 3, and the plate may function as a printing plate.

After the formation of the non-image area 5, as a printing process (process D), a printing process may be started (point "d").

When the printing process is completed, as an ink removal process (process E), the surface of the coating layer 3 is cleaned by wiping off ink, dirt, etc., attached on the surface (point "e").

After the cleaning of the surface is completed, i.e., the ink on the surface is wiped off, as a regeneration process (process F), ultraviolet rays are irradiated onto the surface of the coating layer 3. In this manner, the image area 4*a*, which has been formed by the above-mentioned organic compound, is decomposed and removed so that the surface of the coating layer 3 may be converted so as to be hydrophilic again.

Thereafter, as the non-image area formation process (process A'), the solution containing an organic compound is applied onto the surface again (point "a'") so that the plate is returned to the "initial state of plate-making" again and may be repeatedly utilized as a printing plate.

Next, the process for plate-making and plate-reuse according to the method for making a reusable printing plate, and the reusing method for the printing plate will be explained in detail in the following concrete embodiments confirmed by the inventors of the present invention.

A base material 1, which is made of aluminum, of post card size with a thickness of 0.3 mm was prepared, and a primer LAC PR-01 (a product of Sakai Chemical Industry Co., Ltd.) was applied onto the base material and was dried. The thickness of the primer was 0.8 μm after drying. Note that the primer layer corresponds to the intermediate layer 2 shown in FIG. 1. Thereafter, a titanium oxide photocatalyst coating agent LAC TI-01 was applied and dried at 100° C. to produce a coating layer 3 of 0.4 μm containing a titanium oxide photocatalyst.

Then, after ultraviolet light having a wavelength of 254 nm and an illuminance of 20 mW/cm$^2$ was irradiated over the entire plate surface, i.e., the entire surface of the coating layer 3, for 20 seconds using a low pressure mercury lamp, the contact angle of the portion irradiated by the ultraviolet light with respect to water was immediately measured using a CA-W type contact angle measuring instrument. As a result, the measured contact angle was found to be 7°, and it was confirmed that the portion showed a sufficient hydrophilicity as a non-image area.

Then, 20 g of ethylene-vinyl acetate resin dimuran C2280 (a product of Takeda Chemical Industries, Ltd.) was added to an organic solvent made of 48 parts of Isoper L (a product of Exxon Chemical Co.), 32 parts of toluene, and 20 parts of ethanol, and the solution was heated to 70° C. while being stirred in order to completely dissolve the resin. After this, the solution was cooled to precipitate the fine particles of the above-mentioned resin. The median size of the particle based on volume measured by using a particle size distribution measuring instrument LA-700 (a product of Horiba, Ltd.) was 1.1 μm. This dispersion solution of the resin fine particles was applied onto the entire hydrophilic plate surface by using a roll coating method, and then the plate was left for two minutes at 25° C. to evaporate the solvent present on the printing surface. Thereafter, dot images having image proportions from 10% to 100% with a 10% interval were formed by an image forming device using an infrared beam of 830-nm wavelength, 100-mW/ch output, and 15-μm beam diameter to heat and melt the thermoplastic resin fine particles present on irradiated portions so as to fix on the plate surface. Then, the thermoplastic resin fine particles on the non-image area was washed by spraying water and removed from the print surface. Thereafter, the contact angle of the image area at 100% image proportion and that of the non-image area with respect to water were measured by using the CA-W type contact angle measuring instrument. As a result, the measured contact angle of the image area at 100% image proportion and the non-image area were found to be 92° and 7°, respectively, and it was confirmed that the hydrophobic image area and hydrophilic non-image area were properly formed and that the printing plate was prepared.

The printing plate thus prepared was mounted in a bench offset printing machine New Ace Pro (a product of Alpha Giken Co., Ltd.) and a printing process was carried out at a printing rate of 3,500 sheets/hour using the ink HYECOO B red MZ (a product of Toyo Ink Mfg. Co., Ltd.), water for moistening (Lithofellow 1% solution, a product of Mitsubishi Heavy Industries, Ltd.), and a sheet of paper (ibest paper). As a result, the ink was adhered to the portions on the plate where the dotted images were formed, whereas the ink did not adhere to the portions on the plate where no image area was formed, and accordingly, dotted images were printed on the paper Next, an embodiment of the present invention relating to the regeneration of the printing plate will be explained. After the completion of the printing process and wiping off the ink, fountain solution, paper dust, and the like adhered to the plate, ultraviolet light having a wavelength of 254 nm and an illuminance of 20 mW/cm$^2$ was irradiated over the entire plate surface for 20 seconds using a low pressure mercury lamp. After this, the contact angle of the portion where the dotted image had been present was immediately measured using the CA-W type contact angle measuring instrument. As a result, the measured contact angle was found to be 8°, and it was confirmed that the portion showed a sufficient hydrophilicity.

Figure 6:
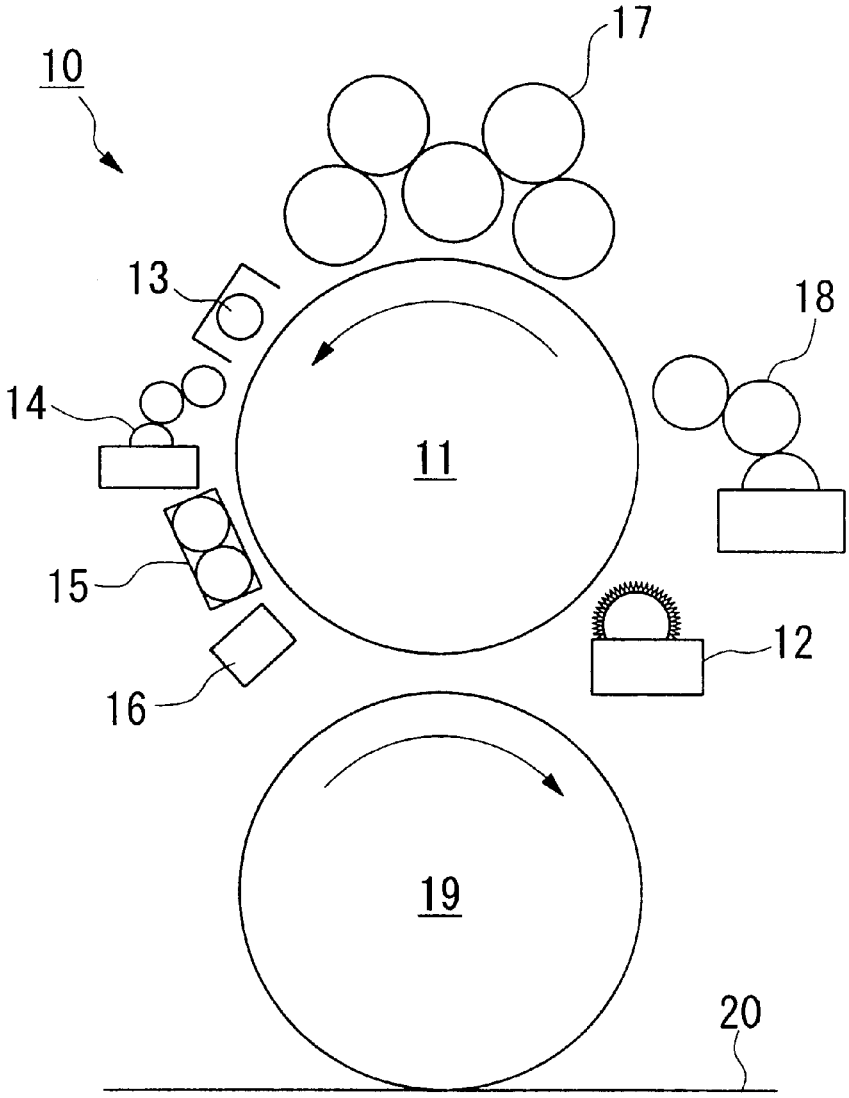
FIG. 6 is a schematic diagram showing an example of the structures of a printing machine according to an embodiment of the present invention.

Note that it is preferable to use a printing machine 10 as shown in FIG. 6 in order to carry out the above-mentioned plate-making, printing process, and the plate regeneration process using a printing machine. The printing machine 10 includes a print drum 11 located at the center, a plate cleaner 12, an ultraviolet light irradiation device 13, a hydrophobic agent application device 14, a dryer 15, an image forming device 16, inking rollers 17, a fountain solution feeder 18, and a blanket drum 19. A printing plate P (not shown in FIG. 6) is placed so as to surround the print drum 11.

The plate cleaner 12 is used to remove ink, fountain solution, paper dust, and the like from the coating layer 3 after the printing process.

The ultraviolet light irradiation device 13 (a regeneration device) is used to decompose and remove the organic compounds forming the image area 4*a* by irradiating ultraviolet light onto the surface of the coating layer 3.

The hydrophobic agent application device 14 is used to apply a solution containing an organic compound which may be decomposed and removed by the irradiation of ultraviolet light, such as thermoplastic resin fine particles, an organotitanium compound, an organosilicone compound (an organosilane compound), or fatty acid dextrin, onto almost the entire surface of the coating layer 3.

The dryer 15 is used to dry the printing plate P, and is capable of readily forming the organic compound layer 4 by evaporating an organic solvent from the solution containing an organic compound, which has been applied onto the surface of the coating layer 3, by drying the coating layer 3.

The image forming device 16 is used to form the image area 4*a* by irradiating infrared light onto the surface of the coating layer 3.

The ultraviolet light irradiation device 13, the hydrophobic agent application device 14, the dryer 15, and the image forming device 16 are placed so as to surround the print drum 11 in that order with respect to the direction of rotation (indicated by the arrow in FIG. 6) of the print drum 11. Accordingly, preparation and regeneration of the plate may be carried out continuously in association with the rotation of the print drum 11, and hence, the preparation and regeneration of the plate can be efficiently performed.

The regeneration process for the plate, which has been used for the printing process, may be carried out by using the printing machine 10 as follows. First, the plate cleaner 12 is set to the position where it makes contact with the print drum 11 so that ink, fountain solution, paper dust, and the like attached to the plate may be wiped off from the plate by the plate cleaner 12. Thereafter, as the regeneration process, the plate cleaner 12 is separated from the print drum 11 and the entire plate surface is irradiated by ultraviolet light emitted from the ultraviolet light irradiation device 13 in order to decompose and remove the organic compound, and convert the plate surface so as to be hydrophilic.

Thereafter, the above-mentioned solution containing an organic compound is applied to the entire surface of the coating layer 3, i.e., the entire printing surface, using the application device 14. Then, the applied solution is dried at a temperature of about room temperature using, if necessary, the dryer 15. In this manner, the organic compound layer 4 is formed on the surface of the coating layer 3 and the plate returns to its initial state of plate-making. Thereafter, as an image area forming process, the image area 4*a* is formed by heating the plate surface using the image forming device 16 based on digital data of an image prepared in advance.

There are two types of processes in the subsequent non-image area formation process in which the organic compound on the non-image area 5, which is a non-heated portion, is removed. First type is a process in which the organic compound is removed from the plate surface by using the plate cleaner 12. Second type is a process in which the organic compound is eliminated by ink tack (i.e., dissolved in ink) and then removed from the plate surface, i.e., a dissolving process.

That is, in the process of first type, the plate cleaner 12 functions also as a hydrophobic agent removing unit, and in the processes of second type, ink (not shown in the figure), the blanket drum 19, and the paper 20 form a hydrophobic agent removing system. The selection may be made based on the type of the organic compound used, i.e., whether the organic compound is soluble or insoluble in the ink used, or if the compound may be removed by the tackiness of the ink. If the process of second type is adapted, the following printing process may be started after the completion of the image area formation process.

In the printing process, the inking rollers 17, the fountain solution feeder 18, and the blanket drum 19 are placed at positions where they may make contact with the print drum 11. A sheet of paper 20 is conveyed in the direction indicated by the arrow in FIG. 6 while making contact with the blanket drum 19. In this manner, the printing process may be carried out continuously.

By using the printing machine 10 shown in FIG. 6, it becomes possible to perform both the plate regeneration process and the printing plate-making process including the plate surface cleaning process after the printing process, the decomposition and the removal of image area by the irradiation of ultraviolet light, the application of the solution containing the above-mentioned organic compound, the formation of the image area via a beating process, and the removal of the organic compound on a non-image area while the printing plate is kept mounted on the printing machine 10. Therefore, according to an embodiment of the present invention, it becomes possible to continuously carry out a series of printing processes without stopping the printing machine 10 or having to perform the troublesome operation of exchanging the plate.

Note that although the printing plate is placed so as to surround the print drum 11 in the above-mentioned printing machine 10, it is not limited as such, and for instance, a coating layer containing a titanium oxide photocatalyst may be directly formed on the surface of the print drum 11, i.e., a print drum and a printing plate may be uniformly formed and used according to an embodiment of the present invention.

Also, although the hydrophobic agent removing unit is constituted by elements which also form another component in the above printing machine, it is possible to have an independent hydrophobic agent removing unit. For example, a hydrophobic agent removing unit may be formed by combining a device which sprays water onto a printing surface and moisture absorption rollers.

According to the plate-making and plate-regeneration methods of the present invention, not only the reuse of the printing plate becomes possible, but also it has an advantage in that its cycle may be accelerated. That is, by combining a titanium dioxide photocatalyst, an organic compound which is readily decomposed by the action of the titanium dioxide photocatalyst, and a technique for forming an image area by heating a surface on which the organic compound has been applied based on digital data, the time required for the plate-making and plate-regeneration processes may be shortened. Accordingly, the printing process as a whole may be completed in a quick manner.

Also, according to the method for making a reusable printing plate, the reusing method for the printing plate, and the printing machine of the embodiments of the present invention, it becomes possible to regenerate and recycle a plate by utilizing: properties of the titanium dioxide photocatalyst, i.e., a property of being made hydrophilic by the irradiation of light having a higher energy than the band gap energy of the photocatalyst, and a property of decomposing an organic material; an organic compound having properties of reacting with or being fixed onto the plate surface by a heating process and being decomposed when irradiated by light having a higher energy than the band gap energy of the photocatalyst; and the technique by which an image area is formed by heating the above-mentioned organic compound present on the plate surface based on digital data so that the organic compound reacts with or is fixed to the plate surface, and it becomes possible to significantly decrease the number of plates which are discarded after use, and hence, the costs for the plates may also be significantly reduced.

Also, according to the present invention, since an image may be formed directly onto the plate, it is applicable to digitization of the printing processes, and therefore, it becomes possible to significantly reduce the time and cost which would have been required without digitization. Moreover, as compared with conventional PS plates, no developing process is necessary, and therefore no waste liquid derived from the developing process is generated.

Further, since both the plate-making process and the print regeneration process may be carried out using the same printing machine, it becomes possible to promptly carry out the printing operation.

In conclusion, according to the method for making a reusable printing plate, the reusing method for the printing plate, and the printing machine of the present invention, the number of plates which are discarded after use may be significantly reduced by regenerating and recycling the plate, and hence, the costs relating to the plates may also be decreased. Also, since the time required for the regeneration of a plate in the printing process is shortened, the time needed for the preparation of a printing process may also be shortened. Moreover, by directly making the plate from digital data, it becomes possible to digitize the printing process, and the time required for the printing processes may be significantly reduced. Further, since the plate-making process and plate regeneration process may be carried out while the plate is maintained mounted to the printing machine, no plate exchanging process is required, and therefore, the efficiency thereof may further be improved.

Having thus described example embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. A method for making a reusable printing plate in which a hydrophobic image area is formed on at least a part of a hydrophilic surface containing a photocatalyst of the printing plate, comprising the steps of:

carrying out a hydrophobic agent application process in which a solution, containing an organic compound having a property of reacting with or being fixed to the surface of said printing plate by a heating process and a property of being decomposed by the action of said photocatalyst when irradiated by light having a higher energy than a band gap energy of said photocatalyst, is applied as a hydrophobic agent on the surface of said printing plate;

carrying out an image area formation process in which at least a part of the surface of said printing plate is subjected to a heating process to form said hydrophobic image area on at least part of said hydrophilic surface; and carrying out a non-image area formation process in which said organic compound applied to an area other than said hydrophobic image area on the surface of said printing plate is removed.

2. A method for making a reusable printing plate according to claim 1, wherein said organic compound is heated by irradiating light having a lower energy than the band gap energy of said photocatalyst so as to react with or be fixed to the surface of said printing plate to form said hydrophobic image area in said image area formation process.

3. A method for making a reusable printing plate according to claim 1, wherein the surface of said printing plate is washed using a washing liquid in said non-image area formation process.

4. A method for making a reusable printing plate according to claim 1, wherein said organic compound is eliminated by ink tack or cleaned with fountain solution and removed in said non-image area formation process.

5. A method for making a reusable printing plate according to claim 1, wherein said photocatalyst is a titanium dioxide photocatalyst.

6. A method for making a reusable printing plate according to claim 1, wherein said organic compound is one of an organotitanium compound, an organo silicone compound, a fatty acid dextrin, a thermoplastic resin, and a mixture thereof.

7. A method for making a reusable printing plate according to claim 1, wherein said solution containing said organic compound is an aqueous solution.

8. A method for making a reusable printing plate according to claim 1, wherein said solution containing said organic compound is an organic solution.

9. A reusing method for a printing plate which is made by using a method as claimed in claim 1, comprising the steps of:

removing ink from the surface of said printing plate after the completion of a printing process; and regenerating said printing plate by converting the surface of said printing plate so as to be hydrophilic by decomposing and removing said hydrophobic image area by the irradiation of light having a higher energy than the band gap energy of said photocatalyst onto the surface of said printing plate.

10. A reusing method for a printing plate made by using a method as claimed in claim 1, comprising the steps of:

removing ink from the surface of said printing plate after the completion of a printing process; and regenerating said printing plate by converting the surface of said printing plate so as to be hydrophilic by alternately carrying out an operation of decomposing and removing said hydrophobic image area by the irradiation of light having a higher energy than the band gap energy of said photocatalyst onto the surface of said printing plate, and an operation of washing the surface of said printing plate by using a washing agent.

11. A printing machine comprising:

a print drum which is provided with a hydrophilic plate surface containing a photocatalyst;

a plate cleaner which removes ink on said plate surface;

a hydrophobic agent application device which applies a solution containing an organic compound having a property of reacting with or being fixed to said plate surface via a heating process and a property of being decomposed by the action of said photocatalyst when irradiated by light having a higher energy than a band gap energy of said photocatalyst as a hydrophobic agent on said plate surface;

an image area formation device which forms a hydrophobic image area by subjecting at least a part of said plate surface to a heating process;

a dryer which dries said plate surface; and a regeneration device which erases said hydrophobic image area by irradiating light having a higher energy than the band gap energy of said photocatalyst onto said plate surface.

12. A printing machine according to claim 11, further comprising:

a hydrophobic agent removing unit which removes said organic compound applied on an area other than said hydrophobic image area on said plate surface.

13. A printing machine according to claim 11, wherein said image area formation device forms an image area by heating said organic compound using irradiation of light having a higher energy than the band gap energy of said photocatalyst so that said organic compound reacts with or is fixed to said plate surface.

14. A printing machine according to claim 11, wherein said photocatalyst is a titanium dioxide photocatalyst.

15. A printing machine according to claim 11, wherein said organic compound is one of an organotitanium compound, an organosilicone compound, a fatty acid dextrin, a thermoplastic resin, and a mixture thereof.

* * * * *